US008353505B2

(12) United States Patent
Kaneko et al.

(10) Patent No.: US 8,353,505 B2
(45) Date of Patent: Jan. 15, 2013

(54) APPARATUS FOR MAKING A BOOKLET-LIKE PRODUCT

(75) Inventors: Isamu Kaneko, Narashino (JP); Hiroshi Yasuzawa, Narashino (JP); Tetsu Ohno, Narashino (JP); Kou Kusume, Narashino (JP)

(73) Assignee: Miyakoshi Printing Machinery Co., Ltd., Narashino-shi, Chiba (JP)

( * ) Notice: Subject to any disclaimer, the term of this patent is extended or adjusted under 35 U.S.C. 154(b) by 273 days.

(21) Appl. No.: 12/952,320

(22) Filed: Nov. 23, 2010

(65) Prior Publication Data

US 2011/0129319 A1 Jun. 2, 2011

(30) Foreign Application Priority Data

Nov. 27, 2009 (JP) ..... 2009-269443

(51) Int. Cl.
*B65H 39/00* (2006.01)
*B41F 13/54* (2006.01)

(52) U.S. Cl. ..... 270/52.09; 270/1.01; 270/5.02; 270/52.07

(58) Field of Classification Search ..... 270/1.01, 270/4, 5.02, 5.03, 20.1, 21.1, 52.07, 52.09; 412/37
See application file for complete search history.

(56) References Cited

U.S. PATENT DOCUMENTS

| | | | | |
|---|---|---|---|---|
| 4,179,107 | A * | 12/1979 | Harris | 270/4 |
| 4,878,981 | A * | 11/1989 | Mizutani | 156/356 |
| 4,939,888 | A * | 7/1990 | Katz et al. | 53/411 |
| 5,230,501 | A * | 7/1993 | Melton | 270/41 |
| 6,821,038 | B2 * | 11/2004 | Izawa | 400/621.1 |
| 6,837,290 | B2 * | 1/2005 | Vijuk et al. | 156/356 |
| 7,658,371 | B2 * | 2/2010 | Deschryver | 270/5.03 |

FOREIGN PATENT DOCUMENTS

| | | |
|---|---|---|
| JP | 10-006666 A | 1/1998 |
| JP | 2002-086966 A | 3/2002 |

* cited by examiner

*Primary Examiner* — Leslie A Nicholson, III
(74) *Attorney, Agent, or Firm* — Westerman, Hattori, Daniels & Adrian, LLP

(57) ABSTRACT

An apparatus for making a booklet-like product comprises a paper feeding part; a superposing part for superposing a plurality of continuous webs of paper fed to travel from the paper feeding part, whereby a layered continuous sheet of paper is prepared; a cutting part for cutting the layered continuous sheet into successive separate layered sheets of paper; a conveyance passage; and a stacking and ejection part for causing the separate layered sheets traveling along the conveyance passage to be piled every predetermined number thereof and to be ejected in the form of piles of sheets, each to form the booklet-like product. The superposing part is provided with a paste nozzle for applying paste to one of two adjacent such continuous webs of paper on its one side and a further paste nozzle for applying paste to the upper surface of the layered continuous sheet.

12 Claims, 4 Drawing Sheets

APPARATUS FOR MAKING A BOOKLET-LIKE PRODUCT

BACKGROUND OF THE INVENTION

1. Technical Field

The present invention relates to an apparatus for making a booklet-like product in which a plurality of continuous webs of paper traveling in rows, which comprise traveling continuous webs of paper of a product width yielded from a traveling continuous web or webs of paper of a width multiple of the product width by cutting in its or their traveling direction(s) with a slitting unit and/or a traveling continuous web or webs of paper of a width equal to the product width, are aligned widthwise into a single row of continuous webs in tiers of paper, and the continuous webs in tiers of paper which while traveling are applied with paste on their later binding sites and thereafter superposed and cut into successive separate layered sheets of paper of a product length which are then piled and conveyed for ejection in the form of piles of sheets each to make a booklet-like product of sheets bound with paste.

2. Background Art

As apparatus in the background art there is one as known from, e.g., JP H10-6666 A in which a continuous web of paper while traveling in a row is cut in its traveling direction by a slitting unit into a plurality of continuous webs of paper traveling in rows, which may while traveling be aligned widthwise to yield a single row of layered continuous sheet of paper, and while traveling be applied with paste. The layered continuous sheet of paper while traveling is cut into separate layered sheets of paper, which are of a product width and which are then piled and ejected to make a booklet-like product.

There is also known an apparatus in which a continuous web of paper of a multiple width while traveling in a row is slit in a direction to yield plural rows of the continuous webs of paper. Thereafter the continuous webs of paper while traveling are applied with paste on sites for later binding. It is shown that the rows of webs of paper may then be aligned widthwise to form a single row of continuous sheets of paper in tiers which are superposed to be joined together by the paste. Thereafter the uppermost continuous sheet of paper may be pasted in a skipping operation in which selected areas thereof are skipped from pasting as shown also in JP 2002-86966 A which is directed to a production by single-row alone system. The layered continuous sheet of paper is then divided into separate layered sheets of a product width which are piled through an impeller in a stacking unit and then ejected. Such an arrangement is designed to largely increase the processing speed of the apparatus.

The prior art apparatus mentioned above have the problems that sheets of paper making up a product are limited to those which are the same in paper quality and that their number is limited to an integral multiple of the number of webs slit into.

In view of what are mentioned above, it is an object of the present invention to provide an apparatus for making a booklet-like product whereby sheets of paper varied in paper quality can be stacked and any number of sheets of paper can make up a booklet-like product.

DISCLOSURE OF THE INVENTION

In order to achieve the object mentioned above, there is provided in a first aspect of the present invention an apparatus for making a booklet-like product, comprising:

a paper feeding part for feeding downstream, a continuous web or webs of paper of a width or widths multiple of and/or equal to a product width;

a superposing part for superposing while matching in phase, a plurality of continuous webs of paper fed to travel from said paper feeding part, said continuous webs of paper comprising:

continuous webs of paper of the product width yielded from the continuous web or webs of paper of the width multiple of the product width by cutting in its or their traveling direction(s) by slitting means and/or the continuous web or webs of paper of the width equal to the product width, whereby a layered continuous sheet of paper is prepared;

a cutting part for cutting the layered continuous sheet into separate layered sheets of paper each of which is of a length of the product;

a conveyance passage along which the separate layered sheets are conveyed to travel; and a stacking and ejection part for causing the separate layered sheets traveling along the conveyance passage to be piled every predetermined number thereof and to be ejected in the form of piles of sheets, each to form the booklet-like product, wherein the superposing part is provided with:

a paste nozzle for applying paste to an area of one of adjacent such continuous webs of paper on its one side which becomes inside when they are mutually opposed to form the layered continuous sheet, and a further paste nozzle for applying paste to areas of the upper surface of the layered continuous sheet, the further paste nozzle being adapted to selectively skip applying paste to those portions of the upper surface each of which is to become the upper surface of the separate layered sheet uppermost in each of the piles of sheets.

The present invention also provides in a second aspect thereof an apparatus according to the first aspect of the invention mentioned above, which comprises a printing part disposed between the paper feeding part and the superposing part for printing variable information on the continuous web of paper fed to travel from the paper feeding part.

The present invention also provides in a third aspect thereof an apparatus according to the first aspect of the invention mentioned above, which comprises a printing part disposed between the paper feeding part and the superposing part, the printing part including a printer for printing variable information on at least one of the continuous webs of paper fed to travel from the paper feeding portion and a bypass for guiding the continuous web of paper not to be printed on.

The present invention also provides in a fourth aspect thereof an apparatus according to any one of the first to third aspects of the invention mentioned above, wherein the stacking and ejection part comprises a piling means for piling the separate layered sheets downwards and a conveyer means for intermittently conveying the separate layered sheets from the piling means while causing them to be received every predetermined number thereof in a plurality of buckets disposed longitudinally of the conveyer means, the apparatus further comprising a single sheet feeding means disposed at each of sides upstream and downstream of the conveyer means with respect to the piling means for feeding a single sheet of paper into the bucket.

The present invention also provides in a fifth aspect thereof an apparatus according to the fourth aspect of the invention mentioned above, wherein the stacking and ejection part includes two such piling means disposed above and for two such conveyer means, respectively, in a conveying direction of the conveyance passage, a switching gate disposed upstream of upstream one of the two piling means for selectively guiding to the two piling means the separate layered sheets conveyed along the conveyance passage and a single ejection conveyer means connected to both downstream sides of the two conveyer means disposed under the two piling means, respectively.

The present invention also provides in a sixth aspect thereof an apparatus according to the fourth or fifth aspect of the invention mentioned above, wherein the single sheet of paper fed into a said bucket in the stacking and ejection part is varied in paper quality from the continuous web(s) of paper fed from the paper feeding part.

According to the aforesaid first aspect of the present invention, it is possible to set at will any number of sheets of paper making up a booklet-like product while maintaining the process efficiency in the process of stacking. Also, varying continuous webs of paper in paper quality makes it possible to turn out products which permit combining sheets of paper different in paper quality. With the paper quality of sheets of paper to make up a booklet-like product being not limited to a single kind, product planning can be facilitated, thus making it possible to expand the scope of the forms of commodity products which can be offered.

Also, it is made possible to manufacture commodity products upon combining sheets of paper varied in paper quality, giving the products distinctive features and thereby enhancing their commodity values and to eliminate inconveniences arising from the limitation in paper quality of makeup sheets.

According to the second aspect of the present invention, desired pieces of variable information can be printed in the printing part on continuous webs of paper fed to travel from the paper feeding part. And, according to the third aspect of the present invention, among continuous webs of paper a selected continuous web of paper is printed by the printer in the printing means and the other is passed through the bypass, it is possible to make a commodity product from a combination of continuous web of paper preprinted with fixed information and continuous web of paper variably printed with a printer. This permits planning diversely and makes it possible to manufacture commodity products which are crisp and well modulated and to expand the scope of commodity products which can be manufactured.

According to the aforesaid fourth aspect of the present invention, piles of sheets prepared by piling separate layered sheets in the stacking and ejection part can be supplied on their upper and lower surfaces with single sheets which can constitute front cover or interleaf varied in paper quality from the sheets making up the piles. Also, varying the number of single sheets makes it to produce a booklet made up of an odd or even number of sheets as desired.

According to the aforesaid fifth aspect of the present invention whereby the conveyance passage is provided in the conveying direction with two such piling means in the stacking and ejection part, it is made possible to selectively pile separate layered sheets on these two piling means, to selectively use the two piling means alternately and thus to prepare a pile of sheets from separate layered sheets piled efficiently.

Further, according to the aforesaid sixth aspect of the present invention, a pile of sheets can be provided at its upper and lower sides with a single sheet of paper which is different in paper quality from the sheets making up the pile, namely as a single sheet of paper that constitutes a front cover or interleaf.

BEST MODES FOR CARRYING OUT THE INVENTION

Figure 1:
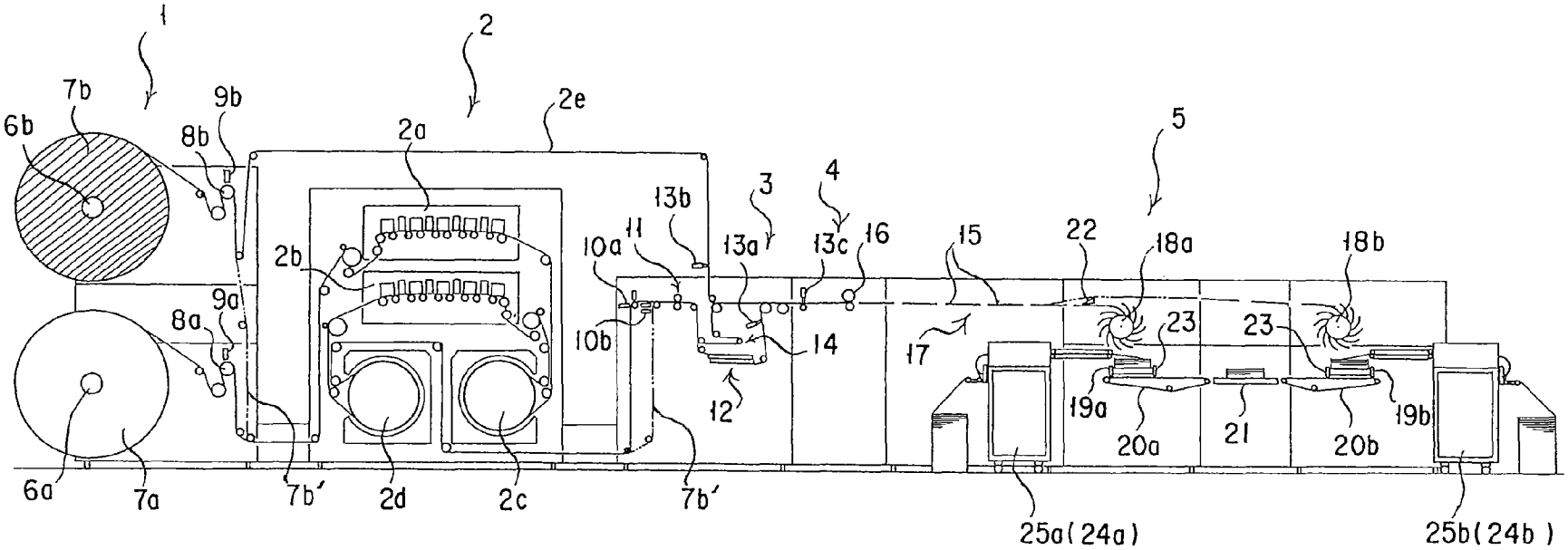
FIG. 1 is a front view diagrammatically illustrating a first form of implementation of the present invention.
Figure 3:
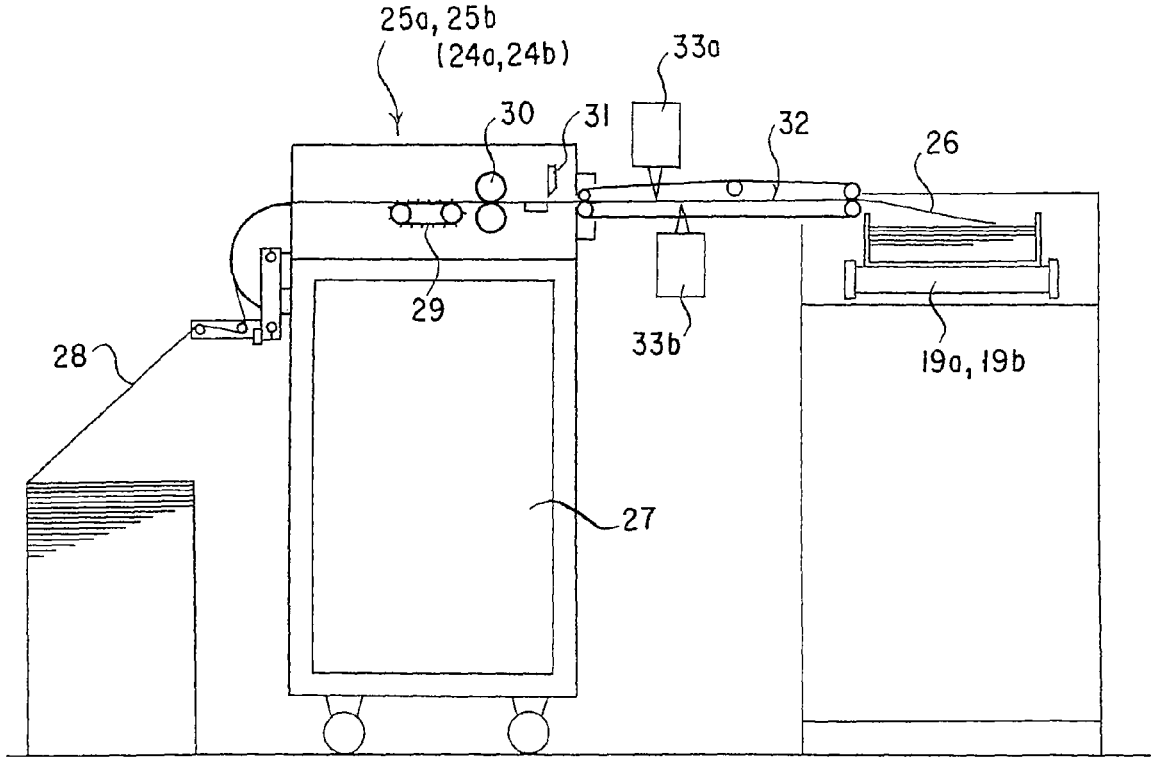
FIG. 3 is a front view diagrammatically illustrating a single sheet feeding unit.
Figure 4:
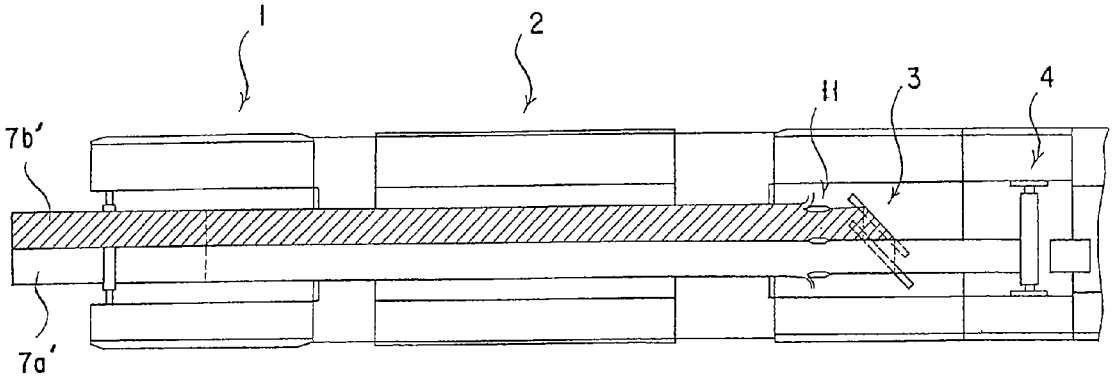
FIG. 4 is a plan view diagrammatically illustrating a second form of implementation of the present invention.
Figure 5:
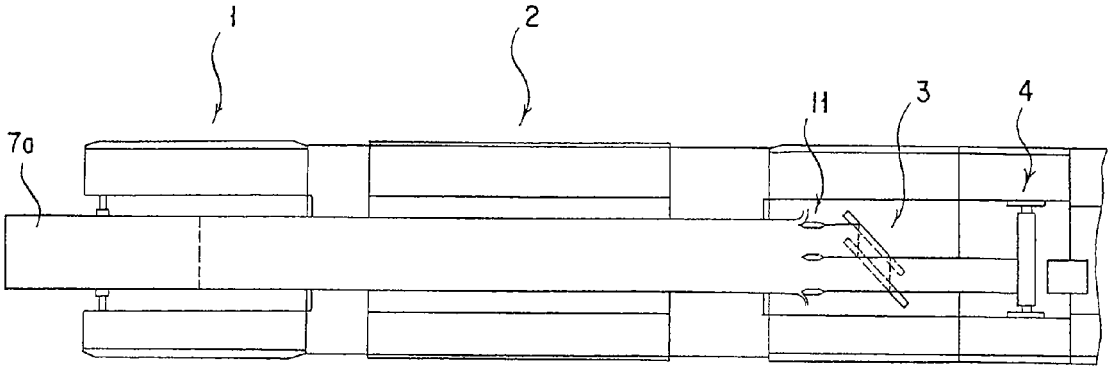
FIG. 5 is a plan view diagrammatically illustrating a third form of implementation of the present invention.

Referring now to the Drawing Figures, an explanation is given of forms of implementation of the present invention. FIG. 1 is a front view diagrammatically illustrating a first form of implementation of the present invention, FIG. 2 is a plan view thereof, FIG. 3 is a front view illustrating a single sheet feeding unit, and FIGS. 4 and 5 are plan views illustrating a second and a third form of implementation of the invention, respectively.

Figure 2:
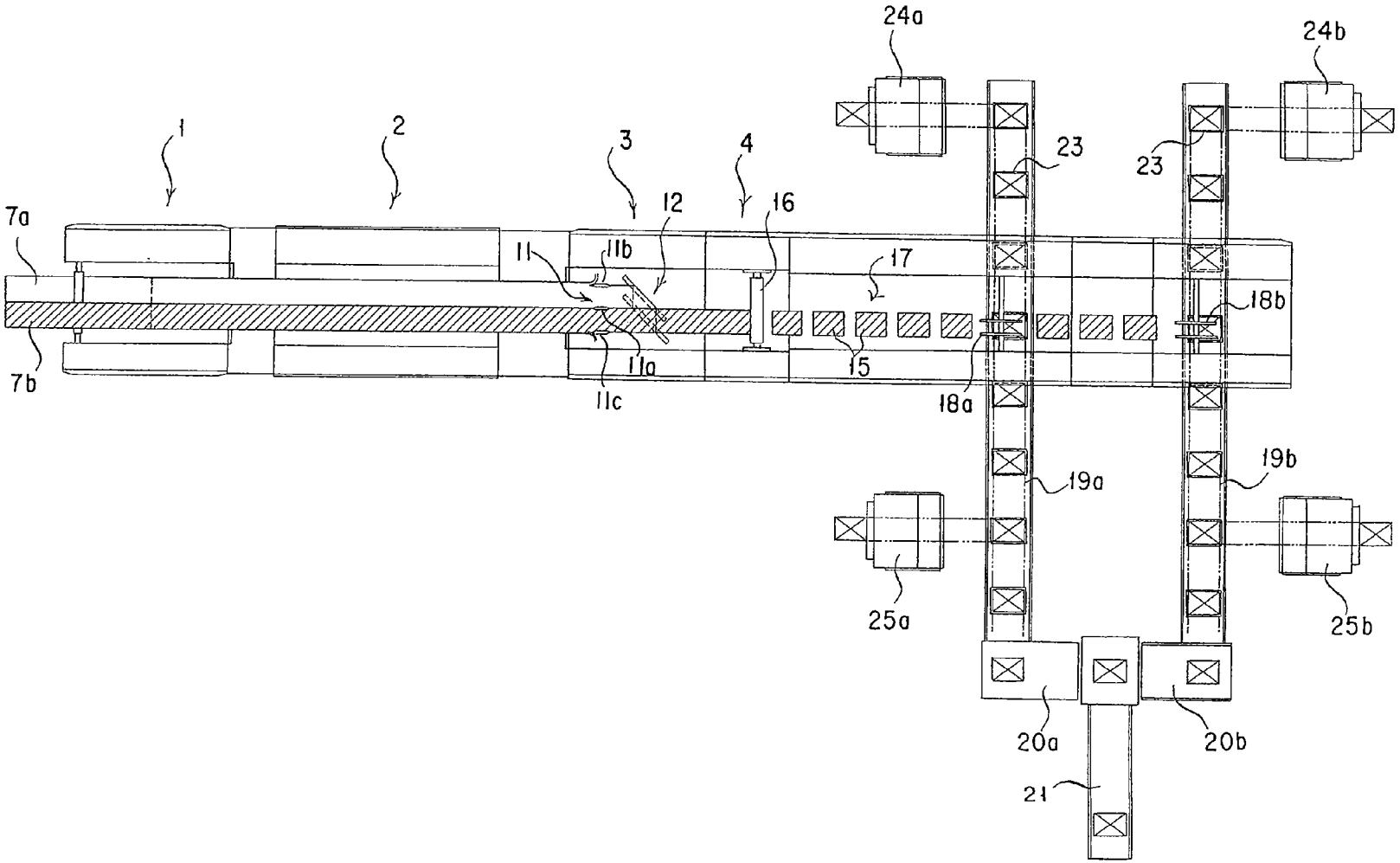
FIG. 2 is a plan view diagrammatically illustrating the first form of implementation of the present invention.

In FIGS. 1 and 2, there are shown a paper feeding part 1, a printing part 2, a superposing part 3, a cutting part 4 and a stacking and ejection part 5.

The paper feeding part 1 is shown provided with a pair of feed shafts, 6*a* lower and 6*b* upper, on which a first and a second continuous web of paper 7*a* and 7*b* in roll are stored and supported, respectively. These first and second continuous webs of paper, lower 7*a* and upper 7*b*, are unrolled and paid out by feed rolls 8*a* and 8*b*, respectively. Then, they are designed to be paid out so that the upper unrolled continuous web of paper 7*b* which is here of a single width travels above the lower unrolled continuous web of paper 7*a* which is here of a double width, in their relative position that the former corresponds to one side half of the latter. In passing, to distinguish the first and second continuous webs of paper 7*a* and 7*b* from each other more clearly, the second continuous web of paper 7*b* is shown by hatched expediently in FIGS. 1 and 2. These continuous webs of paper 7*a* and 7*b* are printed in advance with preselected images or the like, at least timing marks for the purposes of paper feed control, registration and applying paste or the like for each of the separate layered sheets of paper 15 to be created by cutting of these continuous webs at the cutting part 4 as will be described hereinafter, the timing marks preprinted on the first and second continuous webs of paper 7*a* and 7*b* being designed to be sensed by mark sensors 9*a* and 9*b* disposed in opposition to the feed rolls 8*a* and 8*b*, respectively.

The printing part 2 comprises a front surface printer 2*a* for printing on a front surface of continuous web of paper, a rear surface printer 2*b* for printing on a rear surface of continuous web of paper after it is turned over, and driers 2*c* and 2*d* disposed downstream of these printers, respectively. Into this printing part 2 there is designed to pass the first continuous web of paper 7*a* of double width located in the lower side of the paper feeding unit 1. And, use may be made of a plurality of ink jet printers for each of the printers 2*a* and 2*b*. With the printers 2*a* and 2*b* the continuous web of paper 7*a* is continuously printed first on its front and then on its rear surface with images, an individual image for each of such separate layered sheets 15 to be described later. Meanwhile, one of these front and rear surfaces is printed on a portion thereof becoming each of the separate layered sheets 15 with a timing mark for paper feed control, registration and applying paste or the like, each such timing mark being detected by a mark sensor 10*a* disposed downstream of the printing part 2.

Also, the printing part 2 is provided therein with a bypass 2*e* designed to admit passing of the second continuous web of paper 7*b* not passing through the printers 2*a*, 2*b* in the printing part 2.

While in this form of implementation it is illustratively shown to use the first continuous web of paper 7*a* of double width and the second continuous web of paper 7*b* of single width and to pass the first continuous web of paper 7*a* of double width through the printing part 2, as in a second form of implementation as shown in FIG. 4 and to be described later in which when first and second continuous webs of paper 7*a*' and 7*b*' both of single width are paid out from the lower and upper sides, respectively, in the paper feeding part 1, they may be passed to travel lying widthwise (side by side) through the printing part 2 without using the bypass 2*e* as shown by chain line in FIG. 1 so as to print both of them on their respective front and rear surfaces. And, each of the front and rear surfaces of both the continuous webs of paper 7*a*' and 7*b*' is printed meanwhile also on a portion thereof becoming each of the separate layered sheets 15 with a timing mark for paper feed control, registration and applying paste or the like, such timing marks on the continuous webs of paper 7*a*' and 7*b*' being detected by a first and a second mark sensor 10*a* and 10*b*, respectively.

The superposing part 3 is made up of a slitting unit 11, a superposing unit 12, a positioning unit 14, a paste nozzle 13*a*, 13*b* and a further paste nozzle 13*c*. The slitting unit 11 comprises a central slitter 11*a* for dividing by cutting the first continuous web of paper 7*a* of double width centrally widthwise in its conveying or traveling direction and a side slitters 11*b* and 11*b* for cutting both widthwise ends of the continuous web of paper 7*a* in its conveying or traveling direction to render its width into a finish width. The superposing unit 12 comprises a pair of turn bars whereby one side half of the divided first continuous web of paper 7*a* above which the second continuous web of paper 7*b* does not lie is shifted or displaced widthwise into the underside of, and thereby aligned widthwise with, its other side half above which the second continuous web of paper 7*b* does lie, thereby forming a single row of continuous webs in tiers of paper comprising the second continuous web of paper 7*b* and the upper and lower side halves of the divided first continuous web of paper 7*a*. The positioning unit 14 comprises a pair of adjustment rollers over which the upper half of the divided continuous web of paper 7*a* is wound and which are movable relative to each other to make the upper half continuous web of paper adjustable in position in its traveling direction. By relatively moving the adjustment rollers in the traveling direction of the upper half continuous web of paper, its traveling span between them can be adjusted to reposition the upper half continuous web of paper in phase with the lower half continuous web of paper. The paste nozzle 13*a* is designed to apply paste to the inside surface of half of the divided first continuous web of paper 7*a* prior to superposition, whereas the paste nozzle 13*b* is to paste the rear surface of the second continuous web of paper 7*b* prior to superposition so that these continuous webs of paper in tiers become a layered continuous sheet of paper while they are superposed and thereby pasted. The further paste nozzle 13*c* is designed to apply paste to upper surface of the layered continuous sheet comprising the second continuous web of paper 7*b* and the upper and lower side halves of the divided first continuous web of paper 7*a* which are thus bonded together. The paste nozzle 13*a*, 13*b*, 13*c* is designed to apply linear or dotted paste to a selected area of the web as a binding by paste portion of a product.

The cutting part 4 comprises a cutting unit 16 whereby the layered continuous sheet prepared in the superposing part 3 is cut and thereby divided into successive separate layered sheets 15 each of which is a length of the product. And, the separate layered sheets 15 created by dividing of the layered continuous sheet by the cutting unit 16 and spaced apart from each other by a given distance are trans-ported along a conveyance passage 17 by a conveyer means (not shown) into an stacking and ejection part 5. The conveyer means used can be a known conveying means such as a vertical conveyer belt or the like.

The stacking and ejection part 5 includes a first and a second piling unit 18*a* and 18*b* disposed spaced apart from each other in a sheet conveying direction of the conveyance passage 17. Under the first and second piling units 18*a* and 18*b* there are disposed a first and a second conveyer 19*a* and 19*b*, which have the same directions of conveyance orthogonal to the sheet conveying direction of the conveyance passage 17 toward the piling units 18*a* and 18*b*. At the conveying downstream ends of the first and second conveyers 19*a* and 19*b*, there are a first and a second auxiliary conveyer 20*a* and 20*b* opposed to each other and having a direction of conveyance orthogonal to those of the first and second conveyers 19*a* and 19*b*. At the conveying downward ends of the auxiliary conveyers 20*a* and 20*b* where they are opposed to each other, there is positioned an ejection conveyer 21.

At a side upstream of the piling unit 18*a* in the conveyance passage 17 there is provided a transfer direction switching gate 22 which when switched causes the successive separate layered sheets 15 conveyed in the conveyance passage 17 to be transferred and fed selectively to either of the first and second piling units 18*a* and 18*b*.

The piling units 18*a* and 18 used can be typically of impeller type whose rotation causes the successive separate layered sheets 15 conveyed from the conveyance passage 17 to fall and pile successively on the lower conveyers 19*a* and 19*b*, respectively.

The conveyers 19*a* and 19*b* are each constituted of an endless conveyer belt and their conveying sides are arranged to travel in opposition to under sides of the piling units 18*a* and 18*b*, respectively. And, the conveyer 19*a*, 19*b* is provided with buckets 23 for receiving separate layered sheets 15 falling from the piling unit 18*a*, 18*b* and is driven to travel intermittently every time a predetermined number of layered sheets 15 is received and piled in each bucket 23. The time interval of this intermittent travel can be varied according to the number of layered sheets 15 piled in each bucket 23.

The buckets 23 are designed to deform following a change in shape of the conveyer 19*a*, 19*b* at its turning portion so that they may travel, being carried on the conveyer 19*a*, 19*b* without hardness.

An upstream single sheet feeder 24*a*, 24*b* is provided at a side of each conveyer 19*a*, 19*b* upstream of the piling unit 18*a*, 18*b*, and a downstream single sheet feeder 25*a*, 25*b* is provided at a side of each conveyer 19*a*, 19*b* downstream of the piling unit 18*a*, 18*b*. These single sheet feeders are provided to feed into the bucket 23, 23 on the conveyer 19*a*, 19*b*, a single sheet of paper 26 identical in size to each of the successive separate layered sheets 15.

Both the single sheet feeders are identical in makeup, an embodiment of which is described with reference to FIG. 3.

A supporting stand 27 is provided above it with a pin tractor 29 for feeding a continuous web of paper 28 which is formed with pin holes in its both sides, a side slitter 30*a* for trimming off portions of the pin holes at both sides of the continuous web of paper 28, a cutter 31 for cutting the continuous web of paper 28 into separate single sheets of paper 26 each of which is of a selected length, and a single sheet feed conveyer 32 for feeding separate single sheets 26 into the buckets 23 on the conveyer 19*a*, 19*b* at a selected timing.

The upstream single sheet feeder 24*a*, 24*b* is provided at an upper side of its single sheet feed conveyer 32 with a paste nozzle 33*a* for applying paste to a selected area on the upper surface of a single sheet 26 conveyed on the single sheet feed conveyer 32. Also, the downstream single sheet feeder 25*a*, 25*b* is provided at a lower side of its single sheet feed conveyer 32 with a paste nozzle 33*b* for applying paste to an selected area on the lower surface of such a single sheet 26 conveyed on the single sheet feed conveyer 32.

Mention is now made of operations of the apparatus made up as described above.

In the first form of implementation as shown in and described above in connection with FIGS. 1 and 2, the first continuous web of paper 7*a* of double width is set on the lower feed shaft 6*a* and the second continuous web of paper 7*b* of single width is set on the upper feed shaft 6*b*, in the paper feeding part 1. Then, as shown in FIG. 2 the second continuous web of paper 7*b* of single width is positioned in alignment with one side half of the first continuous web of paper 7 of double width.

With timing marks preprinted thereon being detected by mark sensors 9*a* and 9*b*, two continuous webs of paper 7*a* and 7*b* are paid out by the feed rollers 8*a* and 8*b* so as to travel in synchronization with each other according to detected values.

In this form of implementation, the first continuous web of paper 7*a* while passing through the printing part 2 is printed with predetermined images according to the timing marks on its front and rear surfaces and also with timing marks for paper feed control, registration, applying paste and the like on the surface of its one side half to be the lower side continuous web of paper in the superposing part 3 whereafter it is fed to travel into the superposing part 3. The timing marks printed in image printing on the first continuous web of paper 7*a* are detected by the mark sensor 10*a* to keep the first continuous web of paper 7*a* traveling in synchronization with the second continuous web of paper 7*b* traveling by bypassing the printing part 2, both into the superposing part 3. The second continuous web of paper 7*b* is then applied, according to the preprinted timing mark thereon, on an area of its lower surface with paste from the paste nozzle 13*b* immediately upstream of the superposing part 3.

The first continuous web of paper 7*a* is divided widthwise into two halves, two continuous webs of paper, by the central slitter 11*a* upstream of the superposing part 3 and both sides thereof are trimmed off, to form two halves, two continuous webs of paper of a product width. And, one of these two halves, two continuous webs of paper, is displaced widthwise by the superposing unit 12 into the underside of the other so that they are superposed on each other. Then, the other half, continuous web of paper which is not passed through the superposing unit 12 is matched in phase by the positioning unit 14 with the one half, continuous web of paper. Also, with paste from the paste nozzle 13*a* applied then to an upper surface of the one half, continuous web of paper, the two halves, continuous webs of paper are bound together. And, with the second continuous web of paper 7*b* matched vertically and widthwise in phase with, superposed on, and bound with paste to, the upper surface of the other half which is an upper surface of the first continuous web of paper 7*a*, there is prepared layered continuous sheet of paper from the three continuous webs of paper of the product width that are superposed together in the superposing part 3 in which they have been bonded together with paste applied in advance from the nozzle 13*a* and 13*b*. Also, paste is applied by the further paste nozzle 13*c* to areas of an upper surface of the layered continuous sheet at a downstream of the superposing part 3. The further paste nozzle 13*c* is designed to skip applying paste on the layered continuous sheet each time a preselected number of separate layered sheets 15 to be piled in the stacking and ejection part 5 to be described later has been counted and selectively not to apply paste to those portions of the upper surface of the layered continuous sheet each of which is forming the upper surface of the separated layered sheet 15 uppermost in a pile of sheets which is composed of the preselected number of the separate layered sheets 15 piled in the stacking and ejection part 5.

The layered continuous sheet prepared in the superposing part 3 is cut transversely by the cutting unit 16 in the cutting part 4 into successive separate layered sheets of paper 15 which while leaving a given longitudinal space between them are conveyed into the stacking and ejection part 5 along the conveyance passage 17 composed of a conveying means (not shown). And, the separate layered sheets 15 conveyed along the conveyance passage 17 are selectively fed into either of the first and second piling units 18*a* and 18*b* by switching the switching gate 22. A predetermined number of the separate layered sheets 15 are fed to travel alternately into the two piling units 18*a* and 18*b*.

Each conveyer 19*a*, 19*b* in the stacking and ejection part 5 operates intermittently so that the buckets 23 thereon cease moving for a predetermined time in which each bucket 23 is placed under the corresponding piling unit 18*a*, 18*b*. In each time in which the bucket 23 ceases moving, a predetermined number of the separate layered sheets 15 from the piling unit 18*a*, 18*b* are piled one on another in the bucket 23 to form a pile of sheets. And, such piles of sheets are successively conveyed downstream. The piles of sheets conveyed on the conveyer 19*a*, 19*b* are transferred onto the auxiliary conveyer 20*a*, 20*b*, and the piles of sheets carried on the auxiliary conveyers 20*a* and 20*b* are alternately transferred onto the ejection conveyer 21 for ejection therefrom in the form of booklet-like products.

Then, the separate layered sheets 15 piled one on another in each bucket 23 are bonded together with the paste applied by the paste nozzle 13*c*, thereby forming each individual pile of the preselected number of sheets.

Pasting by the paste nozzle 13*c* on the layered continuous sheet is controlled by detecting the timing marks preprinted on the continuous web of paper 7*b* to skip pasting every preselected number of separate layered sheets 15 making up each pile of sheets, thereby to omit applying paste on the uppermost surface of each pile of sheets. Parceling for such piles of sheets may be carried out by applying thereto a known method as shown or described in JP 2002-86966 A.

In the stacking and ejection part 5 mentioned above, single sheets 26 may according to need be fed to lie at the lower and upper sides of a pile sheets prepared in each bucket 23 on the conveyer 19*a*, 19*b*.

In case a single sheet 26 is fed to lie beneath the lower side of a pile of sheets in the bucket 23, a single sheet feeder 24*a*, 24*b* upstream of the conveyer 19*a*, 19*b* is driven in synchronization with the intermittent operation of the conveyer 19*a*, 19*b* to first feed the single sheet 26 in the bucket 23 upstream of the piling unit 18*a*, 18*b*. Then, paste has been applied to an upper surface of the single sheet 26 from the paste nozzle 33*a*. And, a selected number of separate layered sheets 15 are piled by the piling unit 18*a*, 18*b*, forming a pile of sheets, on the single sheet 26 which has been fed into the bucket 23. The single sheet 26 is thus adhered to the lower surface of the pile of sheets.

In case a single sheet 26 is fed to lie on the upper side of a pile of sheets prepared in the bucket 23, a single sheet feeder 25*a*, 25*b* downstream of the conveyer 19*a*, 19*b* is driven in synchronization with the intermittent operation of the conveyer 19*a*, 19*b* to feed the single sheet 26 on the upper surface of the pile of sheets prepared in the bucket 23 by the piling unit 18*a*, 18*b*. Then, paste has been applied to a lower surface of the single sheet 26 from the paste nozzle 33*b*. The single sheet 26 is thereby adhered to the upper surface of the pile of sheets.

According to the first form of implementation, a booklet-like product is thus obtained comprising a pile of sheets composed of a plurality of separate layered sheets 15 piled, each such a separate layered sheet being formed from three layered continuous sheets comprising two continuous sheets which are yielded from a first continuous web of paper 7*a* by dividing the latter widthwise and one continuous sheet which is a second continuous web of paper 7*b*.

In this case, varying the first and second continuous webs of paper 7*a* and 7*b* in paper quality from each other gives rise to a booklet-like product having mixed therein sheets of paper different in paper quality from others at a proportion of one by three. Also, the number of sheets making up a booklet-like product can be changed between an even and an odd number according to the number of separate layered sheets 15 applied with paste and joined together, i.e., by changing the number of the separate layered sheets continuously applied with paste in the process of skip-controlled applying paste on a layered continuous sheet in tiers of paper in order to later bind with paste such separate layered sheets together.

Also, operating the upstream and/or downstream single sheet feeder 24*a*, 24*b*; 25*a*, 25*b* makes it possible to bind to the lower and/or upper side of the pile of sheets, added sheets, such as a printed sheet, a front cover, interleaf or the like, which are different in paper quality from the continuous web or webs of paper in order to produce a booklet-like product having the same.

While in this form of implementation illustrated, variable information is printed online on a first continuous web of paper 7*a* with a printing part 2 having an ink jet printer incorporated in a line, such variable information may be preprinted without using any printing part 2 on the continuous web of paper by paying it out while detecting timing marks thereon to produce a booklet-like product at a like throughput speed by like processing.

FIG. 4 shows a second form of implementation of the present invention. In this form of implementation, a first and a second continuous web of web of paper 7*a*' and 7*b*' used are each of a width equal to the width of a product and are passed to travel side by side. In the superposing part 4 the second continuous web of paper 7*b*' as one of them is displaced widthwise under the lower side of the first continuous web of paper 7*a*' to have the latter superposed on the former. And, by processing a thus-prepared layered continuous sheet in a manner as in the aforementioned form of implementation, it is possible to produce a booklet-like product having different sheets of paper alternately bound. In this form of implementation, too, e.g., the first continuous web of paper 7*a*' lying at the underside may be printed as desired in the printing part 2.

Then, while the first continuous web of paper 7*a*' at the underside of the paper feeding part 1 may be passed through and printed in the printing part 2, both the first and second continuous webs of paper 7*a*' and 7*b*' may be passed to travel side by side through and thereby printed in the printing part 2. To illustrate this aspect, the second continuous web of paper 7*b*' is shown hatched in FIG. 4.

FIG. 5 shows a third form of implementation of the present invention. In this form of implementation there is used one continuous web of paper of double width 7*a*, which is divided by cutting in its traveling direction through the slitting unit 11 into two continuous webs of paper of single width. These two continuous webs of paper, which are of identical paper quality, are superposed in the superposing part 3. In this form of implementation, feeding single sheets 26 which is varied in paper quality in the stacking and ejection part makes it possible for a booklet-like product to comprise sheets which are different in paper quality.

Also, while in the first and second forms of implementation of the invention illustrated, two continuous webs of paper 7*a* and 7*b* are stored and supported in the paper feeding part 1 and paid out to travel, three or more continuous webs of paper may be used. And, a continuous web of paper having fixed information preprinted thereon may be allowed to bypass the printing part 2 while a continuous web of paper to be printed with variable information may be passed through the printing part 2. A number of printers according to a number of continuous webs of paper to be printed with variable information are used in the printing part 2. And, in the superposing part 3 there are superposed such a number of continuous webs of paper as desired.

Also, while the first continuous web of paper 7*a* is of a width twice of the a product width (double width), it may be of a width three or four times of the product width and may be cut by slitters into three or four continuous webs of paper of the product width for supply into the superposing part 4.

While in the first form of implementation illustrated above, a first and a second continuous web of paper 7*a* and 7*b* are preprinted with timing marks for detection by the mark sensors 9*a* and 9*b* opposed to the feed rollers 8*a* and 8*b* to match the continuous webs of paper in phase to each other at the downstream side, these continuous webs of paper 7*a* and 7*b* may not necessarily be preprinted with the timing marks. Then, such timing marks needed to this end are printed on them by the printers 2*a* and 2*b* in the printing part 2 for detection by downstream mark sensors.

What is claimed is:

1. Apparatus for making a booklet-like product, characterized in that it comprises:

a paper feeding part for feeding downstream, a continuous web or webs of paper of a width or widths multiple of and/or equal to a product width;

a superposing part for superposing while matching in phase, a plurality of continuous webs of paper fed to travel from said paper feeding part, said continuous webs of paper comprising:

continuous webs of paper of the product width yielded from said continuous web or webs of paper of the width multiple of the product width by cutting in its or their traveling direction(s) by slitting means and/or said continuous web or webs of paper of the width equal to the product width, whereby a layered continuous sheet of paper is prepared;

a cutting part for cutting said layered continuous sheet into separate layered sheets of paper each of which is of a length of the product;

a conveyance passage along which said successive separate layered sheets are conveyed to travel; and a stacking and ejection part for causing said separate layered sheets traveling along said conveyance passage to be piled every predetermined number thereof and to be ejected in the form of piles of sheets thereof, each to form the booklet-like product, wherein said superposing part is provided with:

a paste nozzle for applying paste to an area of one of adjacent such continuous webs of paper on its one side which becomes inside when they are mutually opposed to form said layered continuous sheet and a further paste nozzle for applying paste to areas of the upper surface of said layered continuous sheet, said further paste nozzle being adapted to selectively skip applying paste to those portions of said upper surface each of which is to become the upper surface of said separate layered sheets uppermost in each of said piles of sheets.

2. An apparatus for making a booklet-like product as set forth in claim 1, characterized in that it comprises a printing part disposed between said paper feeding part and said superposing part for printing variable information on said continuous web of paper fed to travel from said paper feeding part.

3. An apparatus for making a booklet-like product as set forth in claim 2, characterized in that said stacking and ejection part comprises a piling means for piling said separate layered sheets downwards and a conveyer means for intermittently conveying said separate layered sheets from said piling means while causing them to be received every predetermined number thereof in a plurality of buckets disposed longitudinally of said conveyer means, the apparatus further comprising a single sheet feeding means disposed at each of sides upstream and downstream of said conveyer means with respect to said piling means for feeding a single sheet of paper into said bucket.

4. An apparatus for making a booklet-like product as set forth in claim 3, characterized in that said stacking and ejection part includes two such piling means disposed above and for two such conveyer means, respectively, in a conveying direction of said conveyance passage, a switching gate disposed upstream of upstream one of said two piling means for selectively guiding to said two piling means said separate layered sheets conveyed along said conveyance passage and a single ejection conveyer means connected to both downstream sides of said two conveyer means disposed under said two piling means, respectively.

5. An apparatus for making a booklet-like product as set forth in claim 3, characterized in that said single sheet fed into said bucket in said stacking and ejection part is varied in paper quality from said continuous web(s) of paper fed from said paper feeding part.

6. An apparatus for making a booklet-like product as set forth in claim 1, characterized in that it comprises a printing part disposed between said paper feeding part and said superposing part, said printing part including a printer for printing variable information on at least one of said continuous webs of paper fed to travel from said paper feeding portion and a bypass for guiding said continuous web of paper not to be printed on.

7. An apparatus for making a booklet-like product as set forth in claim 6, characterized in that said stacking and ejection part comprises a piling means for piling said separate layered sheets downwards and a conveyer means for intermittently conveying said separate layered sheets from said piling means while causing them to be received every predetermined number thereof in a plurality of buckets disposed longitudinally of said conveyer means, the apparatus further comprising a single sheet feeding means disposed at each of sides upstream and downstream of said conveyer means with respect to said piling means for feeding a single sheet of paper into said bucket.

8. An apparatus for making a booklet-like product as set forth in claim 7, characterized in that said stacking and ejection part includes two such piling means disposed above and for two such conveyer means, respectively, in a conveying direction of said conveyance passage, a switching gate disposed upstream of upstream one of said two piling means for selectively guiding to said two piling means said separate layered sheets conveyed along said conveyance passage and a single ejection conveyer means connected to both downstream sides of said two conveyer means disposed under said two piling means, respectively.

9. An apparatus for making a booklet-like product as set forth in claim 7, characterized in that said single sheet fed into said bucket in said stacking and ejection part is varied in paper quality from said continuous web(s) of paper fed from said paper feeding part.

10. An apparatus for making a booklet-like product as set forth in claim 1, characterized in that said stacking and ejection part comprises a piling means for piling said separate layered sheets downwards and a conveyer means for intermittently conveying said separate layered sheets from said piling means while causing them to be received every predetermined number thereof in a plurality of buckets disposed longitudinally of said conveyer means, the apparatus further comprising a single sheet feeding means disposed at each of sides upstream and downstream of said conveyer means with respect to said piling means for feeding a single sheet of paper into said bucket.

11. An apparatus for making a booklet-like product as set forth in claim 10, characterized in that said stacking and ejection part includes two such piling means disposed above and for two such conveyer means, respectively, in a conveying direction of said conveyance passage, a switching gate disposed upstream of upstream one of said two piling means for selectively guiding to said two piling means said separate layered sheets conveyed along said conveyance passage and a single ejection conveyer means connected to both downstream sides of said two conveyer means disposed under said two piling means, respectively.

12. An apparatus for making a booklet-like product as set forth in claim 10, characterized in that said single sheet fed into said bucket in said stacking and ejection part is varied in paper quality from said continuous web(s) of paper fed from said paper feeding part.

* * * * *